United States Patent [19]

Ulrich et al.

[11] 4,398,381

[45] Aug. 16, 1983

[54] CARTON PACKING STATION FIXTURE

[75] Inventors: Lawrence W. Ulrich; Connie W. Walker, both of Bolingbrook, Ill.

[73] Assignee: Durable Packaging Corporation, Chicago, Ill.

[21] Appl. No.: 219,823

[22] Filed: Dec. 24, 1980

[51] Int. Cl.[3] ..... B65B 67/00

[52] U.S. Cl. ..... 53/393; 53/244; 53/249

[58] Field of Search ..... 53/237, 244, 249, 250, 53/266, 393, 564, 374

[56] References Cited

U.S. PATENT DOCUMENTS

| | | | |
|---|---|---|---|
| 1,893,496 | 1/1933 | Ferguson | 53/374 |
| 3,673,764 | 7/1972 | Bell et al. | 53/374 |
| 3,748,813 | 7/1973 | Sabel | 53/374 |
| 3,842,571 | 10/1974 | Focke et al. | 53/374 |
| 3,959,950 | 6/1976 | Fukuda | 53/374 |
| 4,224,781 | 9/1980 | Salenbo | 53/249 |

*Primary Examiner*—Nicholas P. Godici
*Assistant Examiner*—Kurt Rowan
*Attorney, Agent, or Firm*—Dressler, Goldsmith, Shore, Sutker & Milnamow, Ltd.

[57] ABSTRACT

An apparatus for retaining the bottom flaps of a carton in their infolded position prior to sealing, in a manner which permits filling of the carton.

1 Claim, 4 Drawing Figures

CARTON PACKING STATION FIXTURE

BACKGROUND AND SUMMARY OF THE INVENTON

The present invention relates to apparatus for retaining the bottom flaps of a carton in their infolded position prior to sealing, in a manner which permits filling of the carton.

In the packaging, corrugated and fiberboard cartons have been used for many years. Such cartons are manufactured in the form of flat carton blanks which must be unfolded to form the carton. It has heretofore generally been the practice to infold the bottom flaps of the carton blank and apply a sealing tape thereto, retaining the bottom flaps in place, so as to permit filling of the carton. The present invention is directed to a fixture which retains the bottom flaps of a carton in their infolded position permitting the filling thereof without the application of a sealing tape. This fixture is particularly useful when used in conjunction with modern carton sealing machines which simultaneously apply a sealing tape to the bottom and top flaps of a filled carton.

Accordingly, it is a primary object of the present invention to provide a fixture to retain the bottom flaps in their infolded position so as to permit filling of the carton.

Another object of the invention is to provide such a fixture which is lightweight and portable.

A further object of the invention is to provide such a fixture which accepts a broad range of carton sizes.

A still further object of the invention is to provide such a fixture which can be positioned adjacent the infeed conveyor of an automatic carton sealing machine to function as a packing station.

These and other objects of the invention are realized by the carton packing station fixture of the present invention which comprises a longitudinally extending base plate means and a pair of longitudinally extending flap retaining flange members extending upwardly and outwardly from the longitudinal center axis of the base plate means. The flap retaining flange members are spaced a short distance from the base plate means so as to permit receipt and retension of a corresponding side bottom flap therebetween. The upper surface of the flap retaining flange member prevents the downward movement of a corresponding end bottom flap. The infeed ends of the flap retaining flange members terminate a distance from the infeed end of the base plate means to form a carton set-up portion on the base plate means.

DESCRIPTION OF A PREFERRED EMBODIMENT

Figure 1:
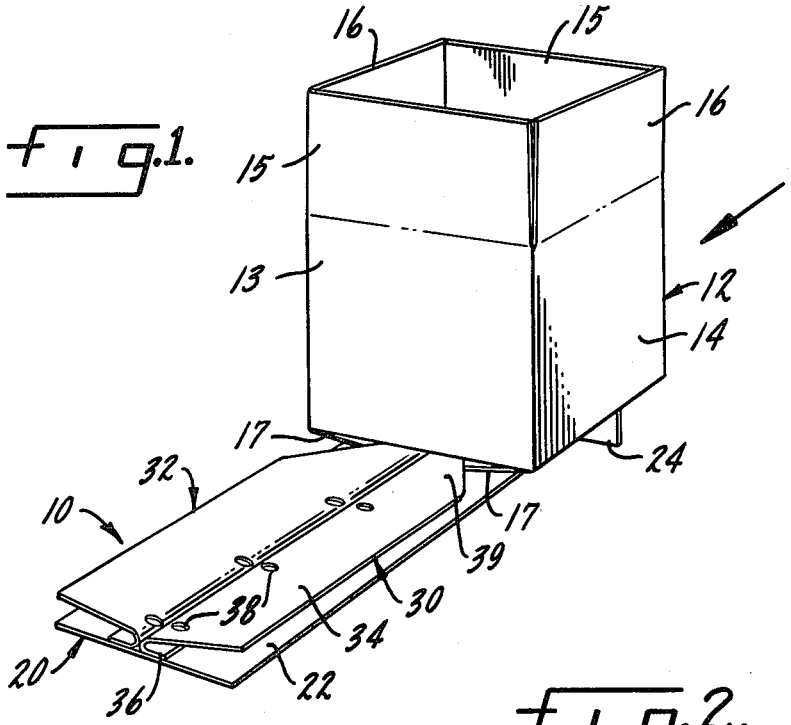
FIG. 1 is a perspective view of the carton packing station fixture constructed in accordance with the present invention shown with a carton positioned on the set-up portion of the base plate means.

Referring in detail to the drawings and in particular to FIG. 1, the carton packing station fixture of the present invention is indicated generally at 10 and is shown receiving a standard carton indicated at 12. Carton 12 includes a pair of end walls 13, a pair of side walls 14, a pair of end top flaps 15, a pair of side top flaps 16, a pair of side bottom flaps 17 and a pair of end bottom flaps (not shown). It is the customary practice to first infold the pair of end flaps and then to infold the pair of side flaps.

Figure 2:
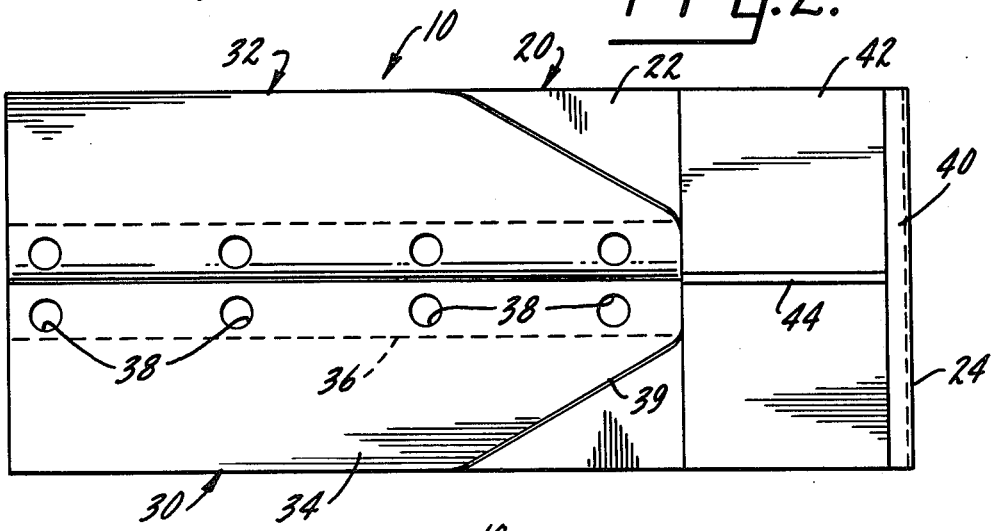
FIG. 2 is a top plan view of the carton packing station fixture constructed in accordance with the present invention.
Figure 3:
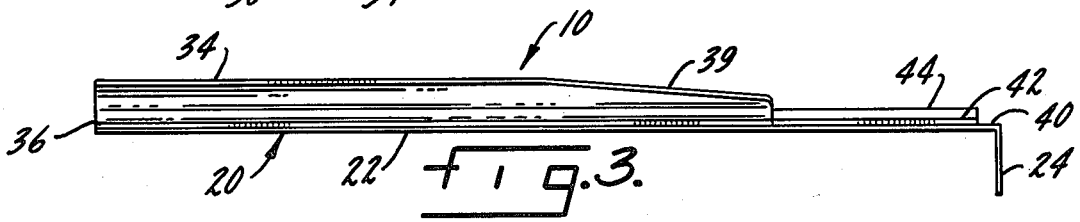
FIG.3 is a side elevational view of the carton packing station fixture as shown in FIG. 2.
Figure 4:
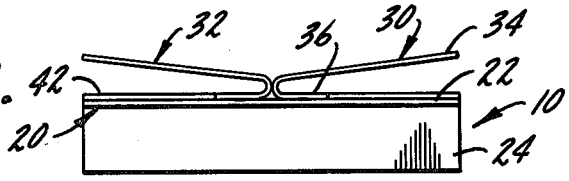
FIG. 4 is an elevational view of the outfeed end of the carton packing station fixture as shown in FIG. 2.

Referring to FIGS. 2–4, the fixture 10 includes a base plate 20 and a pair of longitudinally extending flap retaining flange members 30 and 32. Base plate 20 includes a flat horizontally extending base portion 22 and downwardly extending flange portion 24. Flange members 30 and 32 are secured to the upper surface of portion 22 adjacent the longitudinal center axis thereof and extend upwardly and outwardly therefrom respectively towards a corresponding outer edge of portion 22. Since members 30 and 32 are the mirror image of each other, a specific disclosure of only member 30 will hereinbelow follow.

Flange member 30 includes a portion 34 which extends upwardly and outwardly from the longitudinal center axis of portion 22. The inner edge of portion 34 is spaced a short distance above portion 22 so as to permit sliding receipt of a carton side flap therebetween. The inner edge of portion 34 turns sharply downwardly and then outwardly so to form a securing flange portion 36. Flange portion 36 is secured to portion 22 in a suitable member such as by spot welding. Apertures 38 are preferably provided in portion 34 to facilitate welding portion 36 to portion 22. As best seen in FIG. 2, the corner of the infeed end of portion 34 is cut off to form a wedge shaped infeed end portion 39. End portion 39 is preferably inclined slightly downwardly towards portion 22, as seen in FIG. 3.

The infeed end of portion 39 terminates a sufficient distance from the infeed end of portion 22 to form a carton set-up portion 40 on portion 22. A plate 42 of substantially the same thickness as securing flange 36 is suitable secured on top of portion 40. A longitudinally extending centering flange 44 extends upwardly a short distance from plate 42 in longitudinal alignment with the inner edge of portion 34.

Flange portion 24 may be provided with suitable fastening means (not shown) to secure the fixture 10 to either a work station table or the infeed conveyor of an automatic carton sealing machine.

In operation, a flat carton blank is opened above the set-up portion 40 and the bottom end flaps (not shown) and bottom side flaps 17 are sequentially infolded. The carton 12 is positioned on plate 42 in such a manner as flange 44 is positioned between the respective inner edges of bottom side flaps 17. The carton 12 is then moved inwardly, in the direction of the arrow in FIG. 1, onto portion 22. As carton 12 continues its inward movement, the bottom side flaps are respectively received and retained between flange members 30 and 32 and portion 22 and the bottom end flaps are retained in their infolded by the upper surfaces of flange members 30 and 32. The inward movement of carton 12 is stopped when the infeed end of the carton reaches the outfeed end of fixture 10.

When in this position the carton 12 may be filled while the bottom flaps are maintained in their infolded position. Upon filling of the carton 12, it continues its movement in the direction of the arrow in FIG. 1, leaving the fixture 10 onto either a storage table or an infeed conveyor for an automatic carton sealing machine.

It should be pointed out that the shape of portions 39, and the downward inclination thereof, facilitate the receipt of the side flaps 17. Further, by providing a plate member 42 on portion 40, of the same thickness as flange 36, the inner edges of the side flaps 17 slide unobstructed between flanges 36 and the corresponding portions 34 of members 30 and 32. Also, member 44 is effective to retain the trailing bottom end flap in its infolded position and thereby assure that it will not catch on the infeed end portion 39 as the carton moves into position above portion 22.

The foregoing is a description of a preferred embodiment of the invention which is given here by way of example. The invention is not to be taken as limited to any of these specific features as described, but comprehends all such variations thereof as come within the scope of the appended claims.

What is claimed is:

1. A lightweight, portable carton packing station fixture for retaining the side and end bottom flaps of cartons of different sizes in their infolded position without adjustment to facilitate filling of the carton; comprising:

(a) a longitudinally extending base plate means;

(b) a pair of longitudinally extending flap retaining flange members extending upwardly from the longitudinal center axis of a carton filling portion of said base plate means, said flap retaining flange members include infeed end portions which are wedge shaped and incline downward towards said base plate means, said flap retaining flange members incline downwardly towards the longitudinal axis of said plate means at which point the inner edges thereof turn downward and then outward a short distance so as to form a securing flange portion to secure said flap retaining flange;

(c) said flap retaining flange members being spaced a short distance from said base plate means so as to permit receipt and retension of a corresponding side bottom flap therebetween while the upper surfaces of said flap retaining flange members prevent downward movement of a corresponding end bottom flap such that the side and end bottom flaps are retained in their infolded position so as to permit filling of the carton;

(d) said flap retaining flange members having infeed ends which terminate a distance from the infeed end of said base plate means so as to form a carton set-up and support portion integral with said base plate means; and (e) a carton set-up plate member rigidly secured to the upper surface of said carton set-up and support portion, said carton set-up plate member having a centering flange extending upward therefrom along the center axis thereof for serving as the sole means for centering of the carton prior to its being received by said flap retaining flange members.

* * * * *